United States Patent [19]

Oakes

[11] 4,021,056

[45] May 3, 1977

[54] SKI BOOT WITH SOLE CAVITY BINDING

[75] Inventor: Gilbert B. Oakes, Sugar Hill, N.H.

[73] Assignees: Gilbert B. Oakes; James R. Branch, both of Sugar Hill; Roger A. Peabody, Franconia, all of N.H. ; part interest to each

[22] Filed: Apr. 26, 1976

[21] Appl. No.: 680,093

[52] U.S. Cl. ..... 280/613
[51] Int. Cl.[2] ..... A63C 9/08
[58] Field of Search ..... 280/613, 620, 611

[56] References Cited

UNITED STATES PATENTS

| | | | |
|---|---|---|---|
| 2,693,967 | 11/1954 | Jones, Jr. | 280/613 |
| 3,061,325 | 10/1962 | Glass | 280/613 |
| 3,672,695 | 6/1972 | Baukhage | 280/620 |
| 3,899,190 | 8/1975 | Schweizer et al. | 280/613 |
| 3,931,980 | 1/1976 | Marker | 280/613 |

*Primary Examiner*—Joseph F. Peters, Jr.
*Assistant Examiner*—Milton L. Smith
*Attorney, Agent, or Firm*—Thomas N. Tarrant

[57] ABSTRACT

A ski boot with a central longitudinal cavity in the sole is disclosed in combination with a block designed to mate with the cavity. The block is securable to a ski and laterally-acting detent devices are provided to releasably capture the boot to the block.

10 Claims, 6 Drawing Figures

SKI BOOT WITH SOLE CAVITY BINDING

BACKGROUND OF THE INVENTION:

1. Field of the Invention:

The present invention relates to combinations of ski boots and ski bindings and in particular to such a combination utilizing a sole-cavity binding.

2. Description of the Prior Art:

There has been a continuous trend of improvement in ski bindings to safer and simpler-to-operate arrangements. Operational simplicity suggests a "step-in" binding needing minimal manipulation of a securing harness or mechanism. Safety dictates a binding that will remain secure during any normal skiing maneuvers but will release quickly upon any stress in an abnormal direction that human bones and ligaments are not designed to accept. The sole cavity binding has been receiving some attention recently due, at least in part, to the absence of externally visible encumbrances. These devices have, in the past, primarily employed fore-and-aft-operating locking devices. Since the pivotal points are at the ball of the foot and the bottom center of the heel bone (calcaneus), the usual fore-and-aft engagements are not well suited for pivot point actuation.

Previous attempts, with laterally acting detents, have utilized "step-in" pressure alone to actuate the detents. This approach has generally proven unsuccessful since the detent pressure that will facilitate step-in is too weak to secure the skis to the boots during normal maneuvering.

SUMMARY OF THE INVENTION

Now in accordance with the present invention a ski boot with sole-cavity binding is provided having laterally-acting detents located proximate the pivot points of the wearer's foot. The ski boot fits over a block mating with the sole cavity and attachable to a ski. The block is shorter than the cavity and the two are designed so that, when the block is toward one end of the cavity, the boot goes easily on and off the block due to recesses at the detent locations. When the boot is on the block it may be forced in a fore and aft direction into a detent operative relation in which the block is located toward the opposite end of the cavity. A levering arrangement is provided for moving the boot into the detent operating position.

Thus it is an object of the invention to provide a novel sole-cavity ski boot and binding combination in which the boot is captured at the foot pivot points by laterally-acting detents.

Further objects and features of the invention will become apparent upon reading the following disclosure together with the Drawing.

DESCRIPTION OF THE PREFERRED EMBODIMENT

Figure 1:
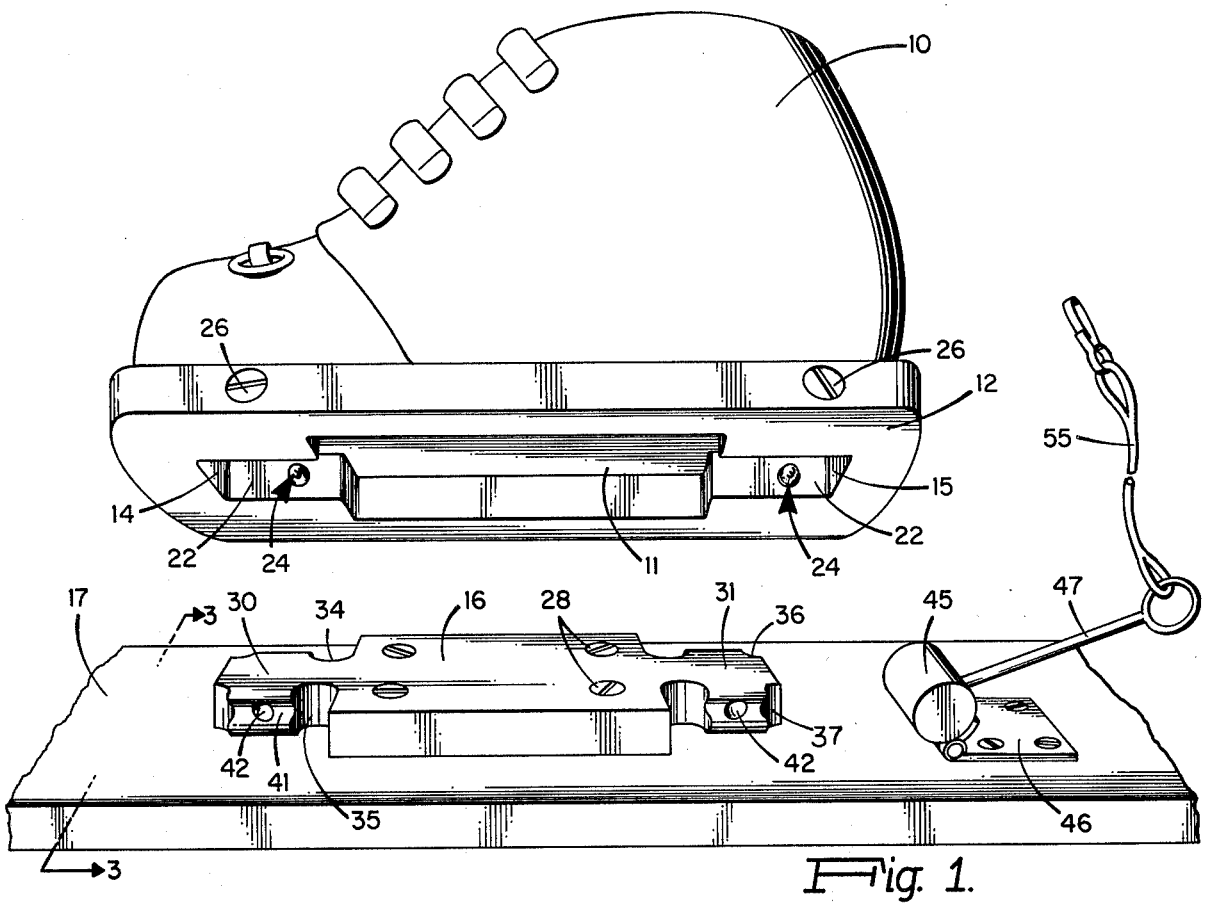
FIG. 1 is a perspective view of a ski boot according to the invention together with a portion of a ski having a block mating with the boot.
Figure 2:
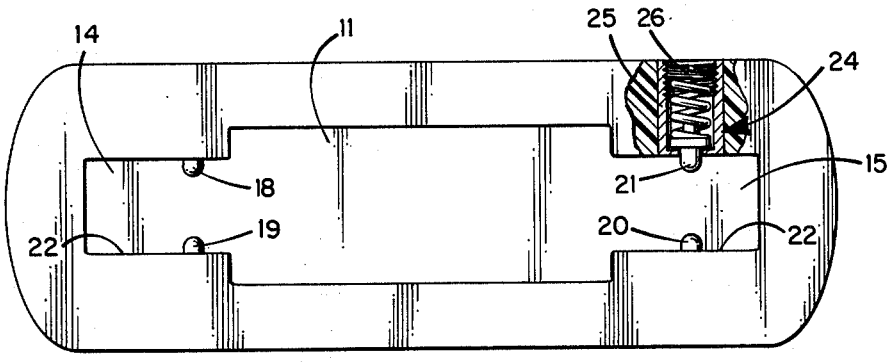
FIG. 2 is a bottom plan view partly in section of the ski boot in FIG. 1.

Referring to FIG. 1 and FIG. 2, ski boot 10 according to the invention has a hollow cavity 11 in sole 12. As depicted in FIG. 2, cavity 11 is generally of an elongated rectangular shape having constricted cavity portion 14 toward the toe end of the boot and second similar constricted cavity portion 15 toward the heel of the boot. Cavity 11 is of a size and shape to mate with block 16 attached to ski 17. Boot 10 is secured to block 16 by laterally acting detents 24 depicted in FIG. 2 by spherical projections 18, 19, 20 and 21 extending inwardly from walls 22 of cavity 11.

There are two major variations in accordance with the invention; one in which detents 24 are actuated into a locking position by placing sole 12 over block 16 and forcing the boot in a forward direction. This is the general embodiment depicted in FIGS. 1 through 5. The second major variation is an arrangement in which detents 24 are actuated by moving the boot rearward into a locking position. The second variation is depicted only in FIG. 6. However, the only change that it effects in the block and the boot is that the detent positioning as shown in FIG. 2 must be reversed as will be explained in further detail below.

Boot 10 is conventional. Sole 12 is suitably made in two pieces (not shown) in which an inner hard frame of plastic or metal acts as a stiffener and a support for detents 24 while an outer piece is made from rubber or a rubberoid material which may be molded or vulcanized both to the inner piece and to the bottom of boot 10. Sole 12 may also be molded in one piece of semi-rigid rubber or plastic material and may be secured to boot 10 by nails, adhesives or other fastening means as well as by molding or vulcanizing.

The size of cavity 11 including portions 14 and 15 is preferably selected as the same for a broad range of usual boot sizes. While this provides an economic advantage in manufacture, a principal reason applies to rental skis and boots where the interchangeability is of particular importance. For this reason the overall length of cavity 11 is desirably in the range of 15 cm to 20 cm. A longer length takes the cavity too close to heel and toe tips in small size boots. A shorter length makes it impossible to place the detents at the preferred separation distance equal to the mean distance between the ball of the foot and the heel bone center for the range of usual sizes.

The width of the central portion of cavity 11 should be in the range of 2 to 5 cm but end portions 14 and 15 are preferably limited to less than 4 cm to allow adequate support for detents 24 in walls 22.

While the central portion of cavity 11 has been depicted as wider than cavity portions 14, 15, the main advantage in this is for strength of block 16 and dependent upon the material and construction of block 16, cavity 11 may be the same width as cavity portions 14 and 15 throughout its length. Block 16 is made to conform to the shape of cavity 11.

Detents 24 are depicted in FIG. 2 as spring-loaded detents provided in bushings 25 in sidewalls 22. Set screws 26 threaded into bushings 25 adjust the spring tension on the detents. Bushings 25 are only necessary if the material of sole 12 is not suitable in itself for supporting detents 24 and carrying threads for set screws 26. Detents 24 mounted at cavity portion 14 are preferably in the range of 2 to 3 cm from the end of cavity portion 14 while detents 24 mounted at cavity portion 15 are preferably in the range of 1 to 2 cm from the end of cavity portion 15.

Figure 3:
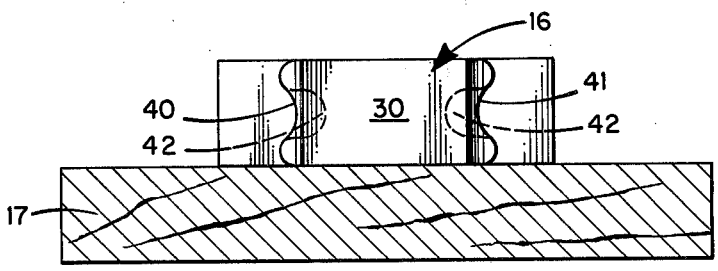
FIG. 3 is a section along 3—3 of the ski in FIG. 1.
Figure 4:
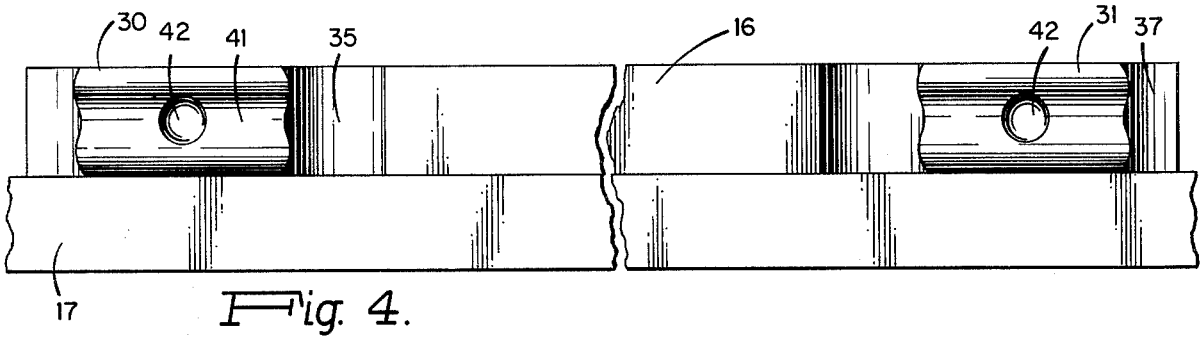
FIG. 4 is a side elevation of the ski in FIG. 1.

Block 16, as depicted in FIGS. 1, 3 and 4 is shaped to fit cavity 11, but is preferably ½ to 1½ cm shorter than cavity 11. The difference in length between cavity 11 and block 16 is selected to match the fore-and-aft displacement required to go from detented to undetented positions. With less than ½ cm the size of the detent becomes a problem while with more than 1½ cm difference between block and cavity, the operation of levering the boot between lock and unlock positions becomes more cumbersome.

Block 16 is suitably made from metal, plastic or wood and is desirably rigid. If made from plastic or wood, a metal reinforcement at the detented locations is desirable to reduce wear. Block 16 is secured to skis by screws 28 or other suitable fastening means. The position on the ski is not relevant to the invention and may be in accordance with prevalent expert opinion of the place and time. Block 16 is completely symmetrical in shape about its central cross-axes so that it may be turned over or end-for-end without effect. One particular reason for this is to simplify installation. End portions 30 and 31 relate to the detent action and preferably only 2½ to 3½ cm at each end cooperate with detents 24.

Two vertical halfround grooves 34, 35 are formed in end portions 30, 31 approximately 27 mm from the end for receiving detents 24 at the toe-end of boot 10. The size of these grooves is determined by the size of the projecting ends of detents 24 to facilitate passage. The extreme ends of end portions 30, 31 are blunt, but rounded at corners 36, 37 for receiving detents 24 at the heel-end of boot 10. Longitudinal halfround grooves 40, 41 in the left and right sides of end portions 30, 31 are provided to facilitate movement of boot 10 relative to block 16 in the fore-and-aft lock-unlock directions. Again the size of the grooves is determined by the size of detents 24. Positive detent stops 42 in the form of spherical depressions are formed midway along grooves 40, 41. The size and location of grooves 34, 35, 40, 41, rounded corners 36, 37 and stops 42 relative to detents 24 is determined to provide some resistance all the way. Thus it is preferable to form and select the parts so that some resistance is felt when detents 24 encounter grooves 34, 35 and corners 36, 37. Likewise it is desirable that a noticeable click occur when detents 24 reach grooves 40, 41.

Figure 5:
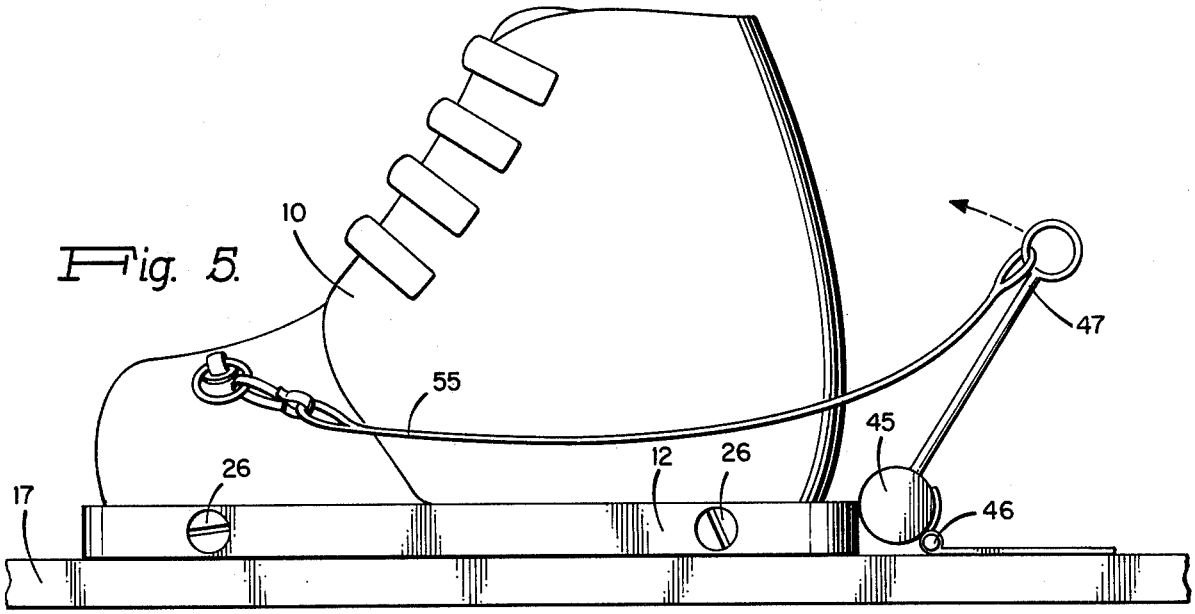
FIG. 5 is a side elevation of a boot according to the invention mounted on a ski and having a lever for forcing the boot forward into a locking position.

In the configuration of FIGS. 1 through 5, grooves 40, 41 must force substantial retraction of detents 24 when boot 10 is moved forward into locking position. Since this provides a resistance that can be difficult for a skier to overcome while on a slippery surface, some form of lever or similar aiding device has been found desirable. Referring to FIG. 5, one such device is readily made with cylinder 45, about 2 to 4 cm in diameter, positioned laterally on ski 17 and secured by hinging device 46. Lever arm 47 welded or otherwise attached to cylinder 45 provides a means of forcing cylinder 45 against sole 12 to push boot 10 forward into the locking position. Removal is much easier by kicking the rear of the ski against the ground or any available obstruction. As depicted in FIG. 5 lever arm 47 terminates in a loop which serves as an anchoring point for retaining strap 55. Strap 55 secures ski 17 to boot 10 in case the ski comes off.

Figure 6:
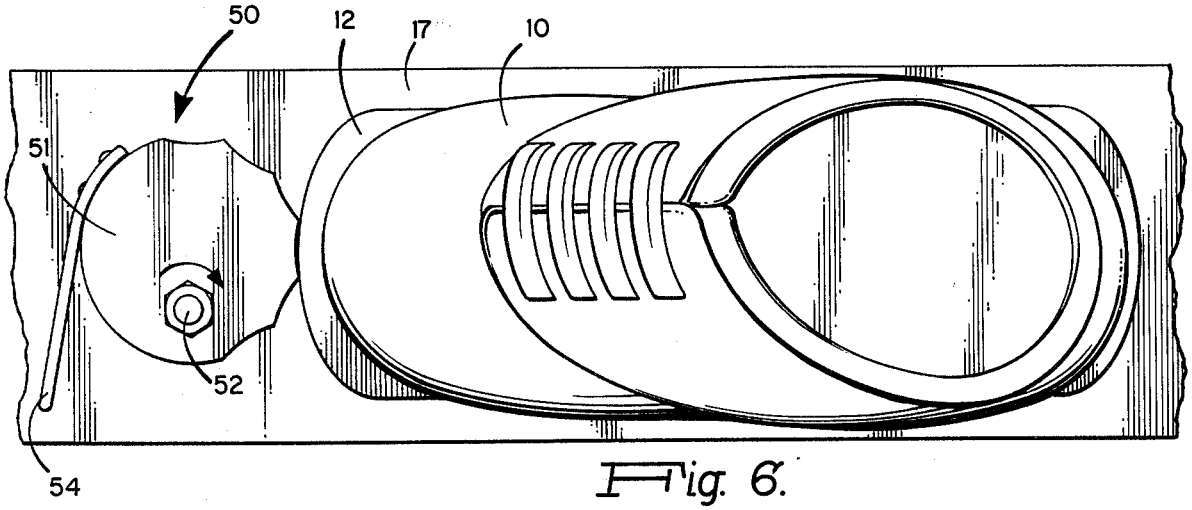
FIG. 6 is a plan view of a boot mounted on a ski showing a cam arrangement for moving the boot rearward into a locking position.

FIG. 6 depicts a second form of lever device 50 in the form of eccentric cam 51 pivoted about pin 52 by lever arm 54. Device 50 operates in a horizontal plane and may be used at the heel of the boot as is the device in FIG. 5. However FIG. 6 depicts an alternative arrangement in which boot 10 is locked by moving it rearward. This requires that the detent locations be reversed. Referring to FIG. 2, detent projections 18 and 19 would have to be toward the heel while projections 20 and 21 would be toward the toe. In locking boot 10 by rearward movement, device 50 must remain in pressure contact against the toe of boot 10. Otherwise boot 10 would slide out of lock everytime the ski met a sudden resistance on the slope such as a patch of slush. To this end, cam 51 carries a series of concavities on its periphery producing detent action. Cam 51 is readily and desirably made of a size and eccentricity to operate with a broad range of boot sizes. It is to be recognized that the device of FIG. 5 can be readily adapted to cover a broad range of boot sizes by utilizing a double hinge, a notched plate below cylinder 45 and a projection from the bottom of cylinder 45 that can be used to engage a selected notch in accordance with the boot size.

While the invention has been described in accordance with specific preferred embodiments, there is no intention to be limited thereby. For example numerous laterally acting detent configurations and shapes of the mating block and cavity can be utilized without departing from the spirit of the invention. Accordingly it is intended to cover the invention in accordance with the scope of the following claims.

I claim:

1. A cavity-sole ski boot and mating ski-attachable block comprising:

a. a ski boot;

b. a sole with a central longitudinal cavity attached to said ski boot;

c. a block mating with said cavity and attachable to a ski, said block comprising:

1. a central rectangular portion;
2. a longitudinally extending forward end having left and right sides and a blunt termination;
3. a longitudinally extending after end having left and right sides and a rear blunt termination;
4. two vertical half-round grooves proximate the juncture of said central rectangular portion with each of said forward end and said after end, one groove being on the left side and one on the right side of the respective end; and
5. a longitudinal half-round groove along each of the left and right sides of each of said forward end and said after end, each groove containing a detent stop;

d. four detents, two of which are located near the forward end of said sole and operate laterally into said cavity and two of which are located toward the after end of said sole and operate laterally into said cavity, whereby said ski boot may be locked to said block by detent action.

2. A cavity-sole ski boot according to claim 1 wherein said cavity is in the range of 15 to 20 cm long and said block is ½ to 1½ cm shorter than said cavity.

3. A cavity-sole boot according to claim 2 wherein said detents are located so that when the detents toward the rear end of the sole are adjacent said rear blunt termination, the detents at the forward end of said sole are adjacent said two vertical half round grooves proximate the junction of said central rectangular portion with said forward end.

4. A cavity-sole ski boot according to claim 1 wherein said detents include set screws threaded into said sole and bearing against the springs of said spring-loaded detents in order to adjust spring tension.

5. A cavity-sole ski boot according to claim 1 wherein the two detents at one end of said sole are at least one cm closer to the end of said cavity than are the two detents at the opposite end of said sole.

6. In skiing apparatus comprising a ski boot having a sole cavity, a ski, a block attached to the top of said ski and mating with said cavity, the combination for securing said boot to said ski comprising:

a. a first pair of detents entering said cavity laterally at the forward portion of said boot;

b. a second pair of detents entering said cavity laterally at the rear portion of said boot;

c. grooves in said block for vertical entry and fore-and-aft locking movement of said first and second pair of detents; and, d. a levering device secured to said ski and operative to bear against said boot so as to move said boot in a fore-and-aft direction relative to said ski in order to move said detents into detent stops.

7. In skiing apparatus according to claim 6 the combination in which said levering device is secured to said ski behind said boot and is operable by a lever arm to force said boot forward relative to said ski.

8. In skiing apparatus according to claim 7 the combination in which said lever arm terminates in a closed loop for securing a retaining strap.

9. In skiing apparatus according to claim 8 the combination wherein said levering device comprises a cylinder positioned laterally of said ski and fastened to said ski by a hinge, said lever arm being rigidly secured to said cylinder whereby said cylinder may be rocked forward on said hinge against the sole of said boot.

10. In skiing apparatus according to claim 6 the combination wherein said levering device is an eccentric cam rotatable in a horizontal plane by a lever arm secured thereto.

* * * * *